United States Patent [19]

Rosen et al.

[11] Patent Number: 4,989,011

[45] Date of Patent: Jan. 29, 1991

[54] DUAL MODE PHASED ARRAY ANTENNA SYSTEM

[75] Inventors: Harold A. Rosen, Santa Monica; James D. Thompson, Manhattan Beach, both of Calif.

[73] Assignee: Hughes Aircraft Company, Los Angeles, Calif.

[21] Appl. No.: 111,909

[22] Filed: Oct. 23, 1987

[51] Int. Cl.[5] ..... H01Q 3/22

[52] U.S. Cl. ..... 342/373

[58] Field of Search ..... 342/373

[56] References Cited

U.S. PATENT DOCUMENTS

| | | | |
|---|---|---|---|
| 3,668,567 | 6/1972 | Rosen . | |
| 4,117,423 | 9/1978 | Rosen . | |
| 4,231,040 | 10/1980 | Walker | 342/373 |
| 4,424,500 | 1/1984 | Viola et al. | 342/373 |
| 4,499,471 | 2/1985 | Luh | 342/373 |
| 4,503,434 | 3/1985 | Luh | 342/373 |
| 4,517,568 | 5/1985 | Willmore | 342/373 |
| 4,584,581 | 4/1986 | Teshirogi | 342/373 |
| 4,584,582 | 4/1986 | Munger | 342/373 |
| 4,638,317 | 1/1987 | Evans | 342/373 |
| 4,689,627 | 8/1987 | Lee et al. | 342/373 |

OTHER PUBLICATIONS

J. Allen, "A Theoretical Limitation on the Formation of Lossless Multiple Beams in Linear Arrays", IRE Transactions on Antennas & Propagation, vol. AP-9, pp. 350-352, (Jul. 1961).

S. Stein, "On Cross Coupling in Multiple-Beam Antennas", IRE Transactions on Antennas & Propagation, vol. AP-10, pp. 548-557 (Sep. 1962).

*Primary Examiner*—Thomas H. Tarcza
*Assistant Examiner*—David Cain
*Attorney, Agent, or Firm*—S. M. Mitchell; R. A. Westerlund; W. K. Denson-Low

[57] ABSTRACT

A phased array antenna system (20; 120) having an array (22; 122) of radiating elements (24-30; H1-H32), such as pyramidal horns, and a distribution network (32; 124) connected thereto, has a dual mode of operation where each mode produces a composite beam which can and preferably does produce an identical far-field electromagnetic radiation pattern. The first composite beam is made up of a plurality of individual beams, forming a linear combination of excitation coefficients ($a_1$-$a_4$) that are mathematically orthogonal to the linear combination of excitation coefficients ($b_1$-$b_4$) of the individual beams of the other composite beam. A plurality of input ports (42-44; 176-178) are provided, and each composite beam is associated with an information-bearing input signal applied to one of the input ports. The distribution network (32; 124) is preferably constructed with at least two stages of signal-dividing devices (52-58; 222-228, 270-282) such as directional couplers and at least a pair of phase-shifting devices (60-62; 230-232, 284-296). By using passive devices, the distribution network (32; 124) is substantially lossless and reciprocal, and can thus also be used for dual mode reception of two distinct beams.

17 Claims, 4 Drawing Sheets

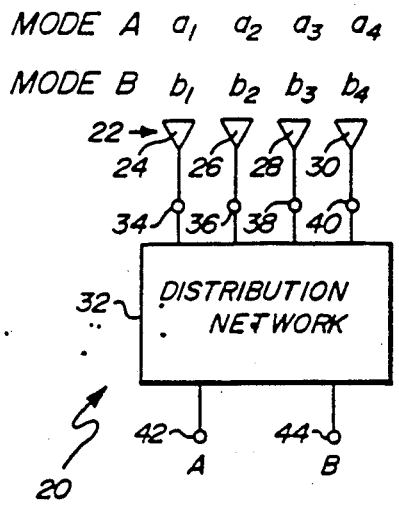
FIG. 1
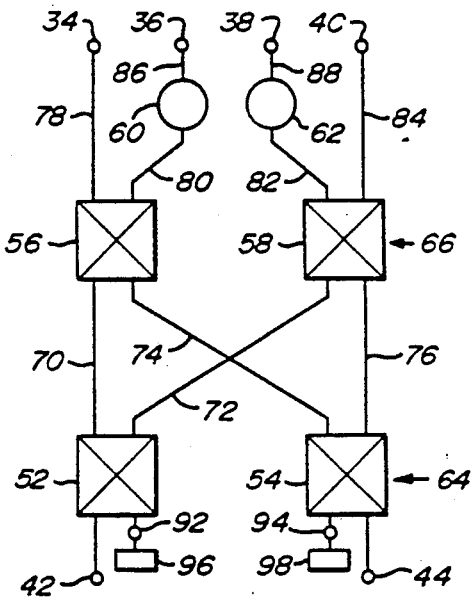
FIG. 2
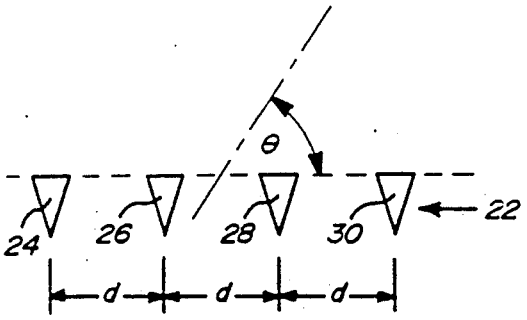
FIG. 3
| ROW NO. | RELATIVE POWER | RELATIVE PHASE |
|---|---|---|
| R1 | .1431 | 2.6° |
| R2 | .2771 | 4.3° |
| R3 | .2984 | 7.2° |
| R4 | .1841 | 9.3° |
| R5 | .0507 | 6.7° |
| R6 | .0025 | -59.3° |
| R7 | .0188 | -139.3° |
| R8 | .0254 | -156.1° |
FIG. 11
FIG. 9
| | MODE A | | MODE B | |
|---|---|---|---|---|
| PORT NO. | RELATIVE POWER | RELATIVE PHASE | RELATIVE POWER | RELATIVE PHASE |
| 186 | .3710 | 0° | .1480 | 180° |
| 184 | .2950 | 0° | .1860 | 0° |
| 182 | .1860 | 0° | .2950 | 0° |
| 180 | .1480 | 180° | .3710 | 0° |

FIG. 4
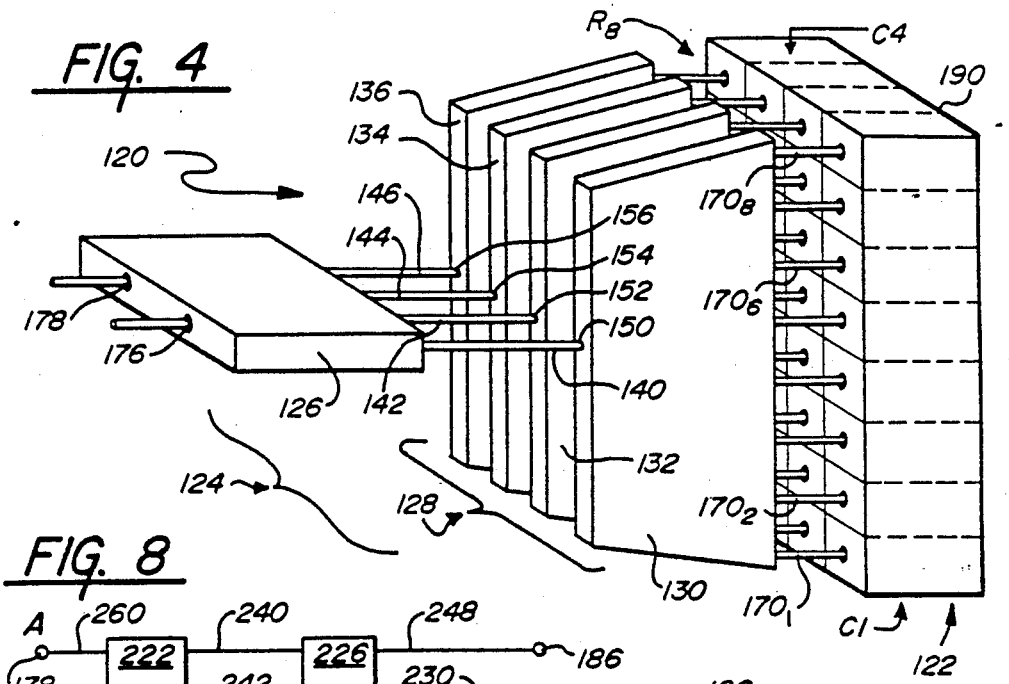
FIG. 8
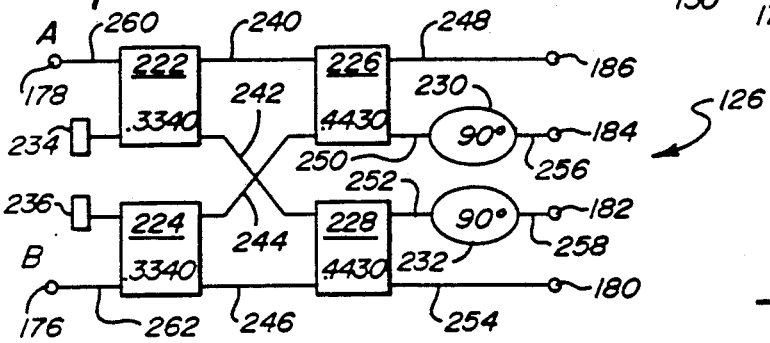
FIG. 10
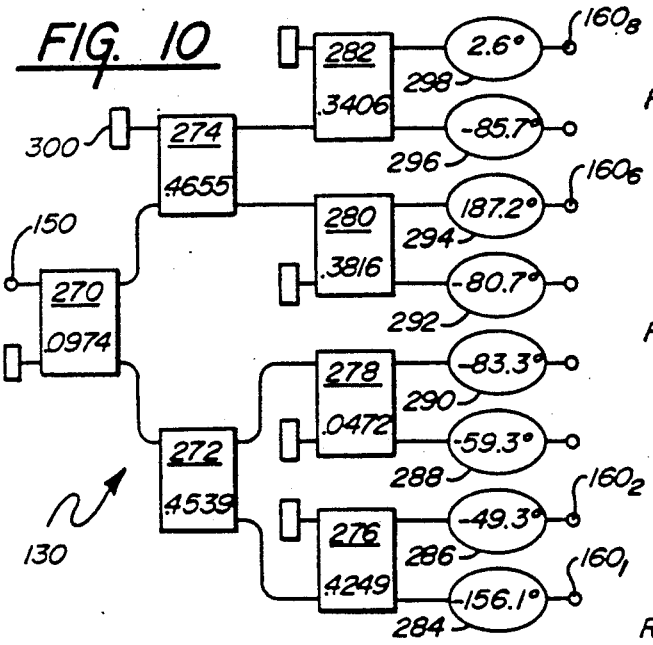
FIG. 5
| C1 | C2 | C3 | C4 |
|---|---|---|---|
| H29 | H30 | H31 | H32 |
| H25 | H26 | H27 | H28 |
| H21 | H22 | H23 | H24 |
| H17 | H18 | H19 | H20 |
| H13 | H14 | H15 | H16 |
| H9 | H10 | H11 | H12 |
| H5 | H6 | H7 | H8 |
| H1 | H2 | H3 | H4 |
R8 R4 R1

FIG. 7

| | | MODE A | | MODE B | |
|---|---|---|---|---|---|
| ROW NO. | HORN NO. | RELATIVE POWER | RELATIVE PHASE | RELATIVE POWER | RELATIVE PHASE |
| R1 | H1 | .05309 | 2.6 | .02118 | -177.4 |
| | H2 | .04221 | 2.6 | .02662 | 2.6 |
| | H3 | .02662 | 2.6 | .04221 | 2.6 |
| | H4 | .02118 | -177.4 | .05309 | 2.6 |
| R2 | H5 | .10280 | 4.3 | .04101 | -175.7 |
| | H6 | .08174 | 4.3 | .05154 | 4.3 |
| | H7 | .05154 | 4.3 | .08174 | 4.3 |
| | H8 | .04101 | -175.7 | .10280 | 4.3 |
| R3 | H9 | .11071 | 7.2 | .04416 | -172.7 |
| | H10 | .08803 | 7.2 | .05550 | 7.2 |
| | H11 | .05550 | 7.2 | .08803 | 7.2 |
| | H12 | .04416 | -172.7 | .11071 | 7.2 |
| R4 | H13 | .06830 | 9.3 | .02725 | -170.7 |
| | H14 | .05431 | 9.3 | .03424 | 9.3 |
| | H15 | .03424 | 9.3 | .05431 | 9.3 |
| | H16 | .02725 | -170.7 | .06830 | 9.3 |
| R5 | H17 | .01880 | 6.7 | .00750 | -173.3 |
| | H18 | .01495 | 6.7 | .00943 | 6.7 |
| | H19 | .00943 | 6.7 | .01495 | 6.7 |
| | H20 | .00750 | -173.3 | .01880 | 6.7 |
| R6 | H21 | .00093 | -59.3 | .00037 | 120.7 |
| | H22 | .00074 | -59.3 | .00047 | -59.3 |
| | H23 | .00047 | -59.3 | .00074 | -59.3 |
| | H24 | .00037 | 120.7 | .00093 | -59.3 |
| R7 | H25 | .00697 | -139.3 | .00278 | 40.7 |
| | H26 | .00554 | -139.3 | .00349 | -139.3 |
| | H27 | .00349 | -139.3 | .00554 | -139.3 |
| | H28 | .00278 | 40.7 | .00697 | -139.3 |
| R8 | H29 | .00943 | -156.1 | .00376 | 23.9 |
| | H30 | .00750 | -156.1 | .00473 | -156.1 |
| | H31 | .00473 | -156.1 | .00750 | -156.1 |
| | H32 | .00376 | 23.9 | .00943 | -156.1 |

DUAL MODE PHASED ARRAY ANTENNA SYSTEM

FIELD OF THE INVENTION

This invention relates in general to array antenna systems, and in particular to dual mode array antenna systems suitable for use in communication systems operating at microwave frequencies, and to passive beamforming networks used therein.

BACKGROUND OF THE INVENTION

In satellite communication systems and other communication systems operating at microwave frequencies, it is known to use single and dual mode parabolic reflector antennas and single mode array antennas. In many applications, it is typical to employ communication systems which have a multitude of channels in a given microwave frequency band, with each channel being at a slightly different frequency than adjacent channels. Typically, the implementation for such multiple channels involves the use of a contiguous multiplexer driving a single mode array antenna.

To minimize interference between microwave signals in or near the same frequency range, it is known to polarize the electromagnetic radiation, for example to have horizontal polarization for one signal and to have vertical polarization for another signal. In such systems, the two types or modes of polarized signals are achieved by providing two separate antenna systems, often side by side, which may use a common reflector, but have two separate, single mode, radiating arrays. Often the two antenna systems are designed to have identical coverage in terms of the far-field pattern of the beams produced by the antenna systems.

In contrast, the present invention is directed toward providing technique for minimizing interference between a plurality of independent microwave signals having the same polarization, which are being simultaneously transmitted to the same geographic location in the same general frequency band when each of the signals have the same polarization. Also, the antenna system of the present invention does not require the use of any reflectors, but instead typically uses a direct-radiating phased array antenna.

Much is known about array antennas, and they are the subject of increasingly intense interest. Phased array antennas are now recognized as the preferred antenna for a number of applications, particularly those requiring multifunction capability. Array antennas feature high power, broad bandwidth, and the ability to withstand adverse environmental conditions. A number of references have analyzed the mathematical underpinnings of the operation of phased arrays. See, for example, L. Stark, "Microwave Theory of Phased-Array Antennas—A Review", *Proceedings of the IEEE*, Vol. 62, No. 12, pp. 1661–1701 (December 1974), and the references cited therein.

Various combinations of radiating elements, phase shifters and feed systems have been employed to construct phased arrays. The types of radiating elements used have included horns, dipoles, helices, spiral antennas, polyrods, parabolic dishes and other types of antenna structures. The types of phase shifting devices have included ferrite phase shifters, p-i-n semiconductor diode devices, and others. Feed systems have included space feeds which use free space propagation and constrained feeds which use transmission line techniques for routing signals from the elements of the array to the central feed point. The constrained feeds typically employ power dividers connected by transmission lines. The number and type of power dividers used depends upon the precise purpose to be served with consideration given to power level and attenuation. Types of constrained feeds include the dual series feed, the hybrid junction corporate feed, parallel-feed beamforming matrices such as the Butler matrix, and others. Large arrays at times have used a feed system which includes a Butler matrix feeding subarrays of phase shifters. As far as the inventors are presently aware, all of these features have been developed for single mode phased arrays.

The development of the Butler matrix around the very early 1960's prompted a number of generalized investigations of conditions for antenna beam orthogonality and the consequences of beam correlation at the beam input terminals. In J. Allen, "A Theoretical Limitation on the Formation of Lossless Multiple Beams in Linear Arrays", *IRE Transactions on Antennas and Propagation*, Vol. AP-9, pp. 350–352 (July 1961), it is reported that in order for a passive, reciprocal beamforming matrix driving an array of equispaced radiators to form simultaneous, individual beams in a lossless manner, the shapes of the individual beams must be such that the space factors are orthogonal over the interval of a period of the space-factor pattern. The term "space-factor" refers here to the complex far-field of an array of isotropic radiators. In particular, Allen shows that array excitations associated with one input port must be orthogonal to the array excitations for any other input port. If two network inputs are identified as a and b, and if the corresponding excitations at the ith element of the array are $a_i$ and $b_i$ respectively, then the excitations are orthogonal when $$\sum_{i=1}^{N} \overline{a_i} \cdot \overline{b_i^*} = 0 \tag{1}$$

where $\overline{b_i^*}$ is the complex conjugate of $\overline{b_i}$.

Allen goes on to show that each input port corresponds to an individual beam and that since the array excitations of one port are orthogonal to those of all other ports, then the individual beam associated with a port is orthogonal to all other individual beams associated with other ports. In S. Stein, "On Cross Coupling in Multiple-Beam Antennas", *IRE Transactions On Antennas and Propagation*, Vol. AP-10, pp. 548–557 (September 1962), there is presented a detailed analysis of the cross coupling of between individual radiating elements of an array as a function of the complex cross-correlation coefficient of the corresponding far-field beam patterns. Special emphasis is given in the Stein article to lossless, reciprocal feed systems.

In each of the foregoing references, only single mode arrays are discussed. The composite beam produced by a single mode array is typically formed from a plurality of individual beams each associated with one of the radiating elements of the array, through constructive and destructive interference between the individual beams, with the interference occurring principally, if not entirely, in space. Even in array antenna systems which employ frequency division multiplexing or time division multiplexing in order have multiple communication channels, the composite beam which is produced is of the single mode variety since only one information-bearing input signal is provided to the feed network driving the antenna array. Moreover, all of the individual beam signals, and thus the composite beam as well, share a common electromagnetic polarization.

In commonly assigned U.S. Pat. No. 3,668,567 to H. A. Rosen, a dual mode rotary microwave coupler with first and second rotatably mounted circular waveguide sections, has first means for launching counter-rotating circularly polarized signals in the first waveguide section, and second means for providing first and second linearly polarized output signals at first and second output ports. The microwave coupler provides an improved and reliable coupling device for applying a pair of output signals from a spinning transmitter multiplexer system through a rotatable joint to a pair of input terminals of a de-spun antenna system such that the signals are isolated during transmission through the coupler, thereby simplifying the design of the multiplexer system. The signals applied to the two input terminals of a two horn antenna system have a phase quadrature relationship, and each includes components from both output signals. As used therein, the dual mode feature refers to the provision of two independent antenna terminals, each providing the same gain pattern and polarization sense, but having differing senses of phase progression across the pattern.

In commonly assigned U.S. Pat. No. 4,117,423 to H. A. Rosen, a similar, but more sophisticated dual mode multiphase power divider having two input ports and N output ports, where N is typically an odd integer, is disclosed. The power divider provides a technique for providing two isolated ports to a single antenna, with the signal from each input port being called a mode and generating nearby the same beam pattern of the same polarization, but with opposite sense of phase progression for each of the two modes. As in the previous patent, counter-rotating circularly polarized signals are launched from the input ports through a cylindrical waveguide member to the output ports. In the preferred embodiment, an N-bladed septa is disposed near the second or output end of a cylindrical waveguide member to enhance the power division and impedance matching between the N output ports.

In both of these patents, the output ports are connected to a plurality of linearly disposed offset feeds at the focal region of the reflector. Specifically, in order to provide a far-field pattern having the same coverage, output signals with equal and opposite phase progressions are placed equidistantly from and on opposite sides of the focal point of the reflector. It is only by using such an off-center feed design in conjunction with a suitable (e.g., parabolic) reflector that the transmission systems described in these two patents are able to provide two modes having substantially the same coverage. It is also worth noting that the excitation coefficients of the output signals are all of equal amplitude and differ only in phase.

To the best of our knowledge, no one has developed or suggested a direct-radiating array antenna system which can be arranged so as to permit dual mode operation. As used herein the term "dual mode" of operation refers to the simultaneous transmission (or reception) of two (or more) distinct composite far-field beams of the same polarization sense in the same general frequency band wherein the composite beams have differing electromagnetic characteristics which enable them to be readily distinguished from one another.

It is the primary object of the present invention to provide a dual mode array antenna system which can produce substantially identical far-field radiation patterns for two composite beams whose excitation coefficients are mathematically orthogonal to one another. Another object is to provide a substantially lossless, reciprocal constrained feed system for such a dual mode array antenna in the form of distribution network made up of passive power-dividing devices and phase-shifting devices interconnected by simple transmission lines. One more object is to provide such a distribution network having a single separate input (or output) port for each distinct information-bearing signal to be transmitted (or received) by the array antenna system.

SUMMARY OF THE INVENTION

Allen, in the above-noted article, was addressing the orthogonality requirements of individual beams where multiple individual beams were generated from a common array of elements connected to a multiple port network. In this invention, we extend beyond Allen by utilizing a linear combination of individual beams to form a composite beam. Specifically, a first linear combination of beams forms a first composite beam which for convenience we call Mode A. A second linear combination of the same individual beams form a second composite beam, which for convenience we call Mode B. A key object of the present invention is providing the same composite coverage for both Mode A and B beams from a common direct-radiating array. This can be done if Modes A and B are othogonal to one another, which means that the array excitations for Mode A must be orthogonal to the excitations for Mode B. This is achieved when:

$$\sum_{i=1}^{N} \overline{A_i} \cdot \overline{B_i^*} = 0 \tag{2}$$

where N is the number of radiating elements in the array, $\overline{A_i}$ and $\overline{B_i}$ are linear combinations of excitation values associated with the individual beams produced by the array, and $\overline{B_i^*}$ is the complex conjugate of $\overline{B_i}$. As is well known, the excitation of the ith element for a composite beam may be described in terms of a series of m individual excitation coefficients (where m is less than or equal to the number N of elements in the array) as follows:

$$\overline{A_i} = x_a\overline{a_i} + x_b\overline{b_i} + x_c\overline{c_i} + \ldots + x_m\overline{z_i} \tag{3}$$

$$\overline{B_i} = y_a\overline{a_i} + y_b\overline{b_i} + y_c\overline{c_i} + \ldots + y_m\overline{z_i} \tag{4}$$

In Equations 3 and 4, $a_i$ through $z_i$ are the excitations for the individual beams a through z (where z is less than or equal to N), and each coefficient "x" or "y" has a magnitude and a phase angle. Each coefficient may be positive or negative and real or complex. It should be appreciated that Equation 2 is much more general than (i.e., allows many more degrees of freedom in designing a distribution network than does) Equation 1, since Equation 1 requires the sum of specified cross-products of the individual beams to be zero, while Equation 2 permits these same cross-products to be non-zero, and only requires that the sum of all specified cross-products from all of the individual beams associated with the two modes A and B be zero.

In light of the foregoing objects, there is provided according to one aspect of the invention, an array antenna system for the simultaneous transmission or reception of at least two distinct composite beams of electromagnetic radiation which have the same polarization, are in the same general microwave frequency range, and are mathematically orthogonal to one another. This array antenna system comprises: an array of elements in direct electromagnetic communication with the beams; and distribution means, in direct electromagnetic communication with the elements of the array and having at least two first ports, for performing at least two simultaneous transformations upon electromagnetic energy associated with the beams as such energy is transferred between the elements and the two ports. The distribution means, and specifically the set of simultaneous transformations performed thereby, enables each of the two distinct beams to be uniquely associated with a distinct information-bearing signal present at the first ports. In the preferred embodiments, the distribution means are arranged such that the two simultaneous transformations enable each of the two beams to be uniquely associated with a distinct information-bearing signal present at a distinct one of the two first ports. In this manner, one information-bearing signal associated with one beam is present at only one of the two ports, while another information-bearing signal associated with the other beam is present at only the other of the two ports. In the preferred embodiments, the distribution means are a lossless, reciprocal, constrained feed structure or beam-forming network constructed of passive devices, and the antenna system can be operated as a phased array if desired.

As a direct-radiating array antenna system, the preferred embodiment of the present invention may alternatively and more particularly be described as being comprised of: an array of radiating elements arranged to transmit electromagnetic radiation, and distribution network means for distributing a plurality of distinct electromagnetic signals, applied to the input ports of the network means in a predetermined manner, to the output ports of the network means such that at least two distinguishable, independent composite beams of electromagnetic radiation having substantially the same far-field radiation pattern emanate from the radiating elements. The distribution network means may be operatively arranged to receive one of the input signals at one of the input ports and another of the input signals at another of the input ports. It may also be operatively arranged so that a first linear combination of individual beams emanating from the array of radiating elements together form a first one of the composite beams, and a second linear combination of individual beams emanating from the array of radiating elements, together form a second one of the composite beams. The network distribution means is operatively arranged so that the array excitations forming the first composite beams and the array excitations forming the second composite beams are mathematically orthogonal to one another.

As a receiving array antenna system which receives a portion of each of at least two composite beams of electromagnetic radiation in the same general frequency range and having the same polarization, which are being transmitted by a remote transmitting station, the preferred embodiment may be somewhat differently described as being comprised of: a plurality of elements each arranged for receiving a portion of each of at least two independent beams of electromagnetic radiation and network means, having a plurality of first ports connected to the elements and a plurality of second ports for separating the two composite beams received by the elements into at least two distinct signals which are respectively output on distinct ones of the second ports, with each such distinct signal being derived from a distinct one of the beams.

These and other aspects, features and advantages of the present invention will be better understood by reading the detailed description below in conjunction with the Figures and appended claims.

BRIEF DESCRIPTION OF THE DRAWINGS

In the accompanying drawings:

FIG. 1 is a simplified block diagram of a first example of a dual mode direct-radiating array antenna system of the present invention;

FIG. 2 is a detailed block diagram of a preferred distribution network for use in the FIG. 1 system;

FIG. 3 is a simplified side view of an array of four radiating elements which may be used in the antenna system of the present invention, and which shows the spacing between the centers of the radiating elements;

FIG. 4 is a view of a simplified perspective second example of a direct-radiating array antenna system of the present invention, which system has an array of 32 radiating elements arranged in a 4×8 planar matrix and constrained feed system for the array comprised of one row distribution and four column distribution networks;

FIG. 5 is a simplified front view showing the array of 32 radiating elements of the FIG. 4 array antenna system;

FIG. 7 is a table of array excitation values associated with the 32-element array of FIG. 5;

FIG. 8 is a detailed block diagram of the row distribution network for the FIG. 4 system;

FIG. 9 is a table of distribution parameters associated with the FIG. 8 network;

FIG. 10 is a representative column distribution network of the FIG. 4 system; and FIG. 11 is a table of the distribution parameters of the FIG. 10 network.

DETAILED DESCRIPTION OF THE PREFERRED EMBODIMENTS

Figure 6:
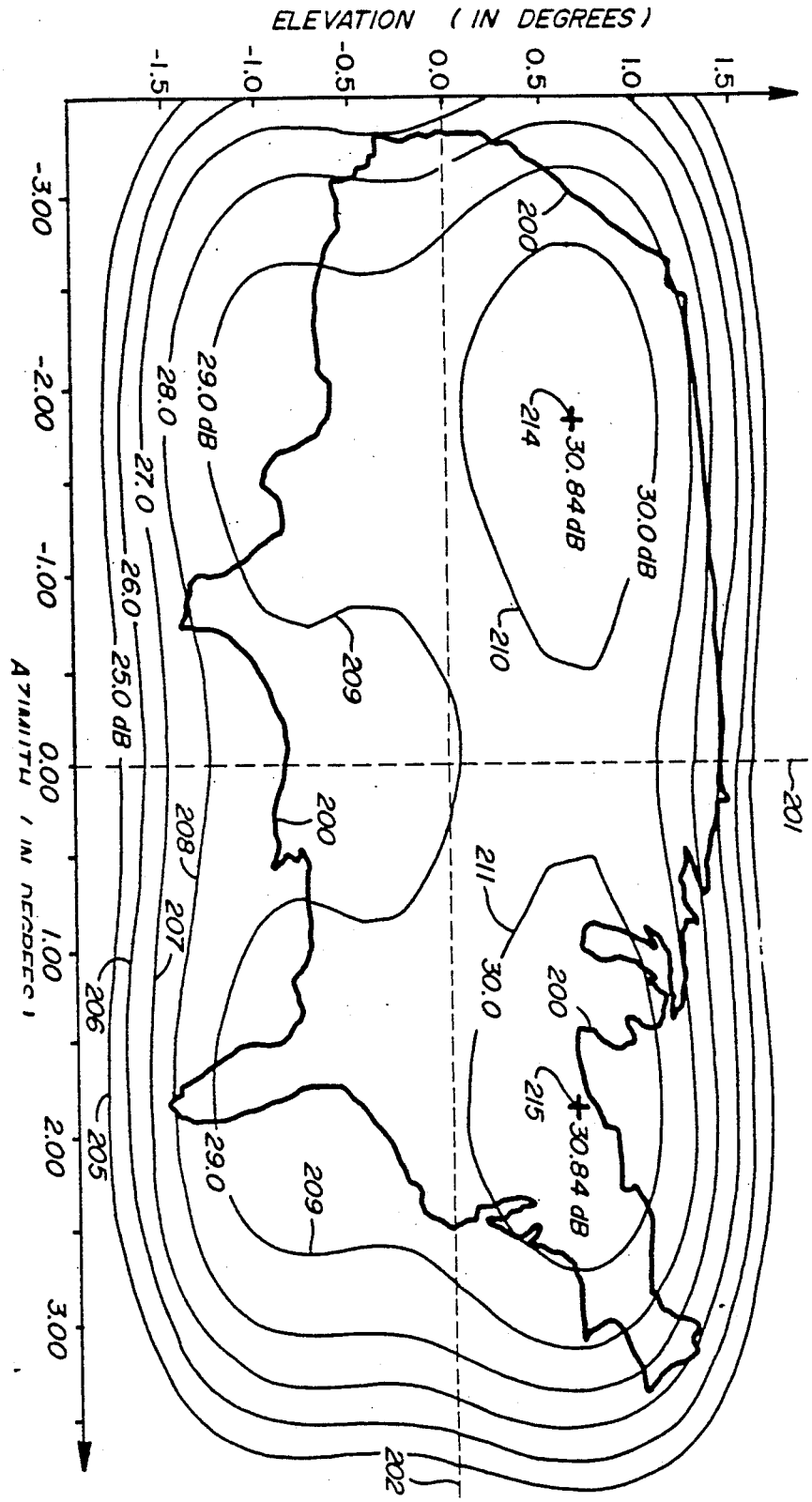
FIG. 6 is simplified view of the Continental United States showing its border, upon which is superimposed a graph of selected constant-gain contours of the beam coverage provided by the FIG. 4 antenna system.

Referring now to FIG. 1, there is shown a dual mode array antenna system 20 of the present invention, which includes an array 22 of four radiating elements 24, 26, 28 and 30 and feed means 32. The elements 24–30 may be of any suitable or conventional type, such as horns, dipoles, helices, spiral antennas, polyrods or parabolic dishes. The selection of the type of radiating element is not crucial to the present invention and such selection may be made based on the usual factors such as frequency band, weight, ruggedness, packaging and the like. Feed means 32 is preferably a distribution network of the type which will be shortly described. The distribution network 32 includes four ports 34, 36, 38 and 40 directly connected to the elements 24, 26, 28 and 30 as shown. Network 32 also includes two ports 42 and 44, which serve as input ports A and B when the system 20 operates as a transmitting antenna (and which serve as output ports A and B when system 20 operates as a receiving antenna).

FIG. 2 shows a detailed circuit diagram of a preferred embodiment for the distribution network 32, which resembles but is not a four port Butler matrix, since it differs in construction and function from a Butler matrix. Network 32, which is also sometimes referred to as a beam-forming network, includes four signal-dividing devices or directional couplers 52, 54, 56 and 58. Network 32 also includes two phase-shifting devices 60 and 62. The devices 52–58 are arranged in two stages 64 and 66 of two devices each. Conventional or suitable connecting lines 70 through 88 are used as needed to provide essentially lossless interconnections between the various devices and ports within the network 32. As used herein, "connecting line" means a passive electromagnetic signal-carrying device such as a conductor, waveguide, transmission strip line, or the like. Whether a connecting line is needed of course depends upon the precise type and lay-out of the distribution network and the location of the various devices within the lay-out. Such details are well within the skill of those in the art and thus need not be discussed. Similarly, connecting lines may be provided as necessary to provide interconnections for electromagnetic signals between the ports 34–40 and their respective feed elements 24–30.

The signal-dividing devices 52–58 used within network 32 of FIG. 2 are preferably hybrid couplers as shown. The hybrid couplers may be of any conventional or suitable type designed for the frequency of the signals to be passed therethrough, such as the 3 dB variety with a 90 degree phase-lag between diagonal terminals. In hybrid couplers 52 and 54, only three out of four terminals of each device are utilized. Terminal 92 of coupler 52 is not used, but instead is terminated by any suitable technique such as conventional resistive load 96. Similarly, terminal 94 of coupler 54 is not used, but instead is terminated by any suitable technique such as resistive load 98.

The phase-shifting devices 60 and 62 are of the +90 degree (phase-lead) type when phase-lag hybrid couplers are employed in the network 32. The devices 60 and 62 may be of any conventional type suitable for the frequency band of the signals passing therethrough.

When the array antenna system 20 is operating as a transmit antenna system, a first information-bearing input signal having an appropriate frequency center and bandwidth is applied to the port 42 (Input A). The distribution network 32 distributes the signal so that a first set of four signals are produced at the output ports 34–40 of network 32 and excite the radiating elements 24–30 to produce a first set of four individual beams of electromagnetic radiation which propagate into space. These four beams may be called the Mode A individual beams, and can be mathematically described in part by a first set of excitation coefficients $a_1$ through $a_4$. When a second information-bearing signal having an appropriate frequency center and bandwidth is applied to port 44 (Input B), the network 32 distributes the signal so that a second set of four signals are produced at the outputs 34–40 and excite the radiating elements 24–30 to produce a second set of four individual beams. These four beams may be called the Mode B individual beams, and can be mathematically described in part by a second set of excitation coefficients $b_1$ through $b_4$. The two sets of four excitation coefficients are shown for convenience above their respective output ports and radiating elements in FIG. 1. These two sets of four individual beams have excitation coefficients that are mathematically orthogonal to one another, as will be further explained.

The four individual beams of each set of beams emanating from feed elements 24–30 combine in space to produce a composite electromagnetic beam. The first composite beam (the Mode A composite beam) produced by the four individual beams of the first set is electromagnetically distinct from and preferably orthogonal to the composite electromagnetic beam (the Mode B composite beam) produced by the four individual beams of the second set.

One important aspect and advantage of the array antenna system of the present invention is its ability to produce two composite beams of electromagnetic radiation which have identical (or substantially identical) radiation patterns for input signals of comparable frequency and bandwidth applied to the two input ports 42 and 44 of network 32. The system 20 is particularly advantageous since it has two input ports 42 and 44, and for any given signal applied to these ports, the resulting composite beams will have identical far-field radiation patterns. This two port feature offers important implications in the channel multiplexing of channelized communication systems, since input signals for the odd-numbered channels may be run into one input port, while the input signals for the even-numbered signals may run into the other input port. This arrangement requires multiplexing equipment which is simpler than a contiguous multiplexer operating with a one input port, single mode array antenna, and which is also simpler than odd and even multiplexers operating with two single mode arrays.

The technical principles of operation of the dual mode array antenna system 20 will be described. Mode A is the mode produced by the signal applied to input port A. Mode B is the mode produced by the signal applied to input port B. For most applications, it is desirable to have the same far-field radiation pattern for the composite beams of the two modes. This is achieved when the excitation coefficients for Mode B are the mirror image of those for Mode A, in other words, when the following conditions are satisfied:

$$\begin{aligned} \overline{b_1} &= \overline{a_4} \\ \overline{b_2} &= \overline{a_3} \\ \overline{b_3} &= \overline{a_2} \\ \overline{b_4} &= \overline{a_1} \end{aligned} \tag{5}$$

In order for the distribution network 32 to be realizable, the excitation coefficients for Mode A must be mathematically orthogonal to those of Mode B. This can be expressed by the formula:

$$\sum_{i=1}^{4} \overline{a_i} \cdot \overline{b_i^*} = 0 \tag{6}$$

The asterisk in Equation 6 indicates that the "$\overline{b_i^*}$" excitation is the complex conjugate of the "$\overline{b_i}$" excitation.

In our first design example we choose to restrict the excitation coefficients to be real (either positive or negative), instead of complex, in order to keep the example relatively simple. In this situation, the above expression reduces to:

$$a_1 a_4 + a_2 a_3 = 0 \tag{7}$$

which can be alternatively expressed as:

$$a_1/a_2 = -a_3/a_4 \quad (8)$$

This relation is easily met. For example, the following coefficients can be selected for the two modes.

$$\text{FOR Mode A: } a_1 = a_2 = a_3 = 0.5 \text{ and } a_4 = -0.5 \quad (9)$$

$$\text{FOR Mode B: } b_1 = -0.5 \text{ and } b_2 = b_3 = b_4 = 0.5 \quad (10)$$

The distribution network 32 shown in FIG. 2 satisfies the conditions of Equations 9 and 10.

The array factor for the two modes can be readily determined from the array geometry shown in FIG. 3. For Mode A, the array factor is $$E_A = 0.5\,(e^{ju} + e^{-ju} + e^{j3u} - e^{-j3u}) \quad (11)$$

which can be re-written as:

$$E_A = \mathrm{COS}(u) + j\,\mathrm{SIN}\,(3u) \quad (12)$$

Similarly, the array factor for Mode B is given by:

$$E_B = \mathrm{COS}(u) - j\,\mathrm{SIN}\,(3u) \quad (13)$$

In Equations 11 through 13, the symbol u is the normalized antenna parameter whose value is given by the following formula:

$$u = (\pi d\,\mathrm{SIN}\,\theta)/\lambda \quad (14)$$

where $\lambda$ is the signal wavelength, $\theta$ is the beam scan angle as shown in FIG. 3, and d is the spacing between the radiating elements. Since the far-field radiation pattern for a composite beam produced by an array of equispaced radiators is proportional to the magnitude squared of the array factor, both Modes A and B will have the same far-field radiation pattern.

Using the principles of operation described above, especially the principles embodied in Equation 2, distribution networks for larger arrays, such as arrays having 8, 16, and 32 or more elements may be readily designed. The general expression for the array factor for Mode A of an array with an arbitrary even number N of elements is:

$$E_A = a_k e^{j\mu} + a_{k+1} e^{-j\mu} + a_{k-1} e^{j3\mu} + a_{k+1} e^{-j3\mu} + \ldots + a_1 e^{j(N-1)\mu} + a_N e^{-j(N-1)\mu} \quad (15)$$

where k=N/2. This can be rewritten as:

$$E_A = (a_k + a_{k+1})\mathrm{COS}(\mu) + j(a_k - a_{k+1})\mathrm{SIN}(\mu) + (a_{k-1} + a_{k+2})\mathrm{COS}(3\mu) + j(a_{k-1} - a_{k+2})\mathrm{SIN}(3\mu) + \ldots + (a_1 + a_N)\mathrm{COS}[(N-1)\mu] + j(a_1 - a_N)\mathrm{SIN}[(N-1)\mu]. \quad (16)$$

The array factor for Mode B of an array with an arbitrary even number of elements is:

$$E_B = (a_k + a_{k+1})\mathrm{COS}(\mu) - j(a_k - a_{k+1})\mathrm{SIN}(\mu) + (a_{k-1} + a_{k+2})\mathrm{COS}(3\mu) - j(a_{k-1} - a_{k+2})\mathrm{SIN}(3\mu) + \ldots + (a_1 + a_N)\mathrm{COS}[(N-1)\mu] - j(a_1 - a_N)\mathrm{SIN}[(N-1)\mu]. \quad (17)$$

The general expression for the array factor for Mode A of an array with an arbitrary odd number N of elements is:

$$E_A = a_L + (a_{L-1} + a_{L+1})\mathrm{COS}(2\mu) + j(a_{L-1} - a_{L+1})\mathrm{SIN}(2\mu) + (a_{L-2} + a_{L+2})\mathrm{COS}(4\mu) + j(a_{L-2} - a_{L+2})\mathrm{SIN}(4\mu) + \ldots + (a_1 + a_N)\mathrm{COS}[(N-1)\mu] + j(a_1 - a_N)\mathrm{SIN}[(N-1)\mu]. \quad (18)$$

where L=(N+1)/2. The array factor for Mode B of an array with an arbitrary odd number N of elements is:

$$E_B = a_L + (a_{L-1} + a_{L+1})\mathrm{COS}(2\mu) - j(a_{L-1} - a_{L+1})\mathrm{SIN}(2\mu) + (a_{L-2} + a_{L+2})\mathrm{COS}(4\mu) - j(a_{L-2} - a_{L+2})\mathrm{SIN}(4\mu) + \ldots + (a_1 + a_N)\mathrm{COS}[(N-1)\mu] - j(a_1 - a_N)\mathrm{SIN}[(N-1)\mu]. \quad (19)$$

The dual mode array technology of our invention can be further understood by means of a second design example illustrated in FIGS. 4–11. For convenience, this second example will be described as a transmitting antenna system. FIG. 4 shows a dual mode array antenna system 120 which has a planar array 122 of 32 contiguous radiating elements configured in a rectangular or matrix arrangement of four columns C1–C4 by eight rows R1–R8, as best shown in FIG. 5. The array 122 is driven by a constrained feed system 124 which is comprised of a first or horizontal distribution network 126 and a group or set 128 of four second or vertical distribution networks 130–136. The horizontal distribution network 126 is connected by connecting lines 140 through 146 to the input ports 150–156 of networks 130–136. The vertical distribution networks 130–136 are identical and each have a single input port and eight output ports which are connected to one column of radiating elements in the array 122. Vertical distribution network 130 is typical, and has a single input port 150 and eight output ports $160_1$–$160_8$, which are interconnected to the eight radiating elements of column C1 by connecting lines $170_1$–$170_8$. The first distribution network 126 has two input ports 176 and 178, and four output ports 180–186.

A view of the front 190 of array 122 is shown in FIG. 5. Each of the elements is a conventional waveguide pyramidal horn using vertical polarization. Each element is approximately 4.68 inches in height and 3.915 inches in width, which dimensions are also the distances between vertical and horizontal centers. The array antenna system 120 is intended to provide substantially uniform (i.e., relatively constant gain) coverage for the Continental United States (i.e., the 48 contiguous states) from a communications satellite in geosynchronous orbit at a position at 83 degrees west longitude over the frequency range of 11.7 to 12.2 GHz. The array dimensions were selected using well-known antenna design techniques applicable to single mode antenna designs.

The resulting coverage beams from the array were generated using a conventional computer program of the type well-known in the art for simulating array antenna performance. The beams for Modes A and B are identical to each other and to the beam pattern shown by the constant-gain curves or contours in FIG. 6. The pattern shown in FIG. 6 is a composite or average over three frequencies (11.7, 11.95 and 12.2 GHz).

Since the patterns for Mode A and Mode B are identical to each other, those in the art will appreciate that antenna system 120 of FIG. 4 provides dual mode coverage gain over the intended area comparable to that expected of single mode array antenna system designs. In FIG. 6, the outline of the Continental United States is indicated by heavy line 200, the vertical and horizontal centers of the bore sight of antenna system 120 are indicated by dotted lines 201 and 202, and the constant gain contours (in decibels) corresponding to 25.0 dB, 26.0 dB, 27.0 dB, 28.0 dB and 29.0 dB are indicated respectively by lines 205, 206, 207, 208 and 209. The two constant gain contours corresponding to 30.0 dB are indicated by lines 210 and 211. The western and eastern locations of the maximum gain of 30.84 dB are indicated by crosses 214 and 215.

The array excitations for array 122 are listed in the table of FIG. 7. Specifically, the table lists relative power and relative phase for each element or horn for both Modes A and B. The excitations listed in FIG. 7 were generated by a conventional computer program which uses a standard iterative search technique that seeks to optimize the antenna gain over the coverage region of interest for both Modes, while simultaneously requiring that the element excitations for the two Modes be orthogonal, that is satisfy Equation 2 above. The contents of the FIG. 7 table are the results produced by one such iterative search program.

Inspection of the FIG. 7 table will reveal that each row or horizontal group of four elements of the array 122 operates in a dual mode fashion and has the same dual mode parameters. For example, in Mode A, element H1 gets 37.10% of the power in the first row R1, element H5 gets 37.10% of the power in the second row R2, element H9 gets 37.10% of the power in the third row R3, etc. In every row the relative distribution of power and the relative phase is the same as in every other row. Some rows get more total power than other rows, but within each row the relative power distribution among the elements of that row is the same. This is also true for phase shifts (which are expressed in degrees in the table). Thus, the array 122 is dual mode in the azimuth direction and conventional or single mode in the elevation direction.

Since each row is dual mode with the same relative distributions common to all rows, the overall distribution network 124 to provide the array excitations may consist of one dual mode two-to-four row network 126, followed by four column distribution networks 130–136. This is the arrangement previously shown in FIG. 4. Those skilled in the art will realize that a complimentary distribution may also be used, namely two column distribution networks followed by eight two-to-four horizontal distribution networks. However this latter arrangement actually contains more couplers than the arrangement shown in FIG. 4, and thus the simpler FIG. 4 implementation is preferred.

A detailed block diagram of a preferred construction of the dual mode two-to-four network 126 is shown in FIG. 8. Network 126 is composed of four couplers 222–228 and two phase shifters 230 and 232, and is a modified form of an N=4 Butler matrix. Suitable termination devices 234 and 236 are provided for the unused ports of couplers 222 and 224. The various connecting lines 240–262, between input terminals 176 and 178, couplers 222–228, phase shifters 230 and 232, and output terminals 180–186, provide essentially lossless interconnections between various devices and ports within the network 126. Each coupler 222–228 has its cross-coupling value (either 0.3340 or 0.4430) listed therein, and imparts a −90 degrees phase shift to the cross-coupled signal passing therethrough. Thus, from input port 178, a signal entering the first coupler 222 will have 33.40% of its power coupled to line 242, which signal is then distributed by coupler 228 to output ports 180 and 182. The coupler 222 also imparts a −90 degrees phase shift to this coupled signal passed to line 242. The direct output of the first coupler 222 on line 240 will have 66.6% (100−33.40) of the power of signal A. Coupler 222 imparts no phase shift (0 degrees) to the portion of signal A delivered to this direct or uncoupled output connected to line 240. The distribution parameters for the two-to-four network 126 of FIG. 8 are presented in the table shown in FIG. 9. This table indicates the fractional power and net phase shift for each path through the network 126.

A preferred construction for a typical column distribution network, namely representative network 130, is shown in FIG. 10. Network 130 has a standard corporate feed structure composed of seven directional couplers 270–282 and has eight phase shifters 284–298. The directional couplers 270–282 function in the same general manner as the couplers shown in FIG. 8, and the cross-coupling values for each coupler is shown therein in FIG. 10. Similarly, the phase shift values (in degrees) of each phase shifter 284–298 are shown therein. The distribution parameters of the FIG. 10 network, that is relative power and relative phase between the inputs 150 and the outputs $160_1$–$160_8$, are indicated in the table shown in FIG. 11. Suitable termination devices, such as device 300, are provided at the unused input port of each of the directional couplers 270–282.

Networks 126 and 130–136, and all of the connecting lines and terminating loads used therewith, may be fabricated using conventional microwave components well-known to those in the antenna art, such as waveguide or TEM (transverse electromagnetic mode) line components.

The antenna array system 120 illustrated in FIGS. 4–11 is dual mode in one dimension (the row or horizontal direction, which corresponds to the azimuth direction parallel to dotted line 202 in FIG. 6), and single mode in the other dimension (the column or vertical direction, corresponding to the elevation direction parallel to dotted line 201 in FIG. 6). We recognize, however, that the present invention as described above may be readily extended to an array of radiating elements which is dual mode in both dimensions (azimuth and elevation). Such an antenna array system would have four modes, two in each dimension. Those skilled in the art will appreciate that having dual mode in both dimensions (for a total of four modes) violates no fundamental principles, and may be implemented by simply extending the computations required in conjunction with Equation 2 from one dimension to two dimensions. In such a case, the array would have four composite beams having the same (or substantially the same) far-field coverage or beam pattern.

While the foregoing discussion of array antenna systems 20 and 120 has primarily described these two systems as transmitting systems, those skilled in the art will readily appreciate that each of the systems will also function quite nicely as a receiving antenna system as well. When the antenna system 20 is used for example, as a receiver, the first ports 34–40 of network 32 become input ports while ports 42 and 44 become output ports.

The network 32 then functions as a means for separating the composite beams received by the elements 24–30 into two distinct signals which are effectively routed to either output port 42 or output port 44, since the network is fully reciprocal. Since network 32 as shown in FIG. 2 is constructed of only passive devices, it is reciprocal and lossless, and all of the principles of operation explained earlier apply to the system 20 as a receiving antenna system. Clearly, the same type of comments may be made about array antenna system 120 shown in FIGS. 4–11.

One important advantage of the dual mode antenna systems of the present invention is that they can be readily constructed from existing, well-developed and understood microwave components organized in the general form of familiar constrained feed structures. No new component devices need to be developed or perfected to implement the antenna systems of the present invention. Another advantage of the antenna systems of the present invention is that they do not require a reflector, as do the dual mode antenna systems described in the aforementioned U.S. Pat. Nos. 3,668,567 and 4,117,423.

As presently contemplated, the dual mode antenna systems of the present invention will likely have greatest utility in the microwave frequency ranges, that is frequencies in the range from 300 MHz to 30 GHz. Also, in a typical application for our dual mode antenna systems the first and second information-bearing signals will occupy the same general frequency range, but this is not required.

Having thus described the invention, it is recognized that those skilled in the art may make various modifications or additions to the preferred embodiment chosen to illustrate the invention without departing from the spirit and scope of the present contribution to the art. Also, the correlative terms, such as "horizontal" and "vertical," "azimuth" and "elevation," "row" and "column," are used herein to make the description more readily understandable, and are not meant to limit the scope of the invention. In this regard, those skilled in the art will readily appreciate such terms are often merely a matter of perspective, e.g., rows become columns and vice-versa when one's view is rotated 90 degrees. Accordingly, it is to be understood that the protection sought and to be afforded hereby should be deemed to extend to the subject matter claimed and all equivalents thereof fairly within the scope of the invention.

What is claimed is:

1. A direct-radiating array antenna system comprising:

an array of radiating elements arranged to transmit electromagnetic radiation; and distribution network means, having a plurality of input ports and a plurality of output ports connected to the radiating elements, for distributing a plurality of distinct electromagnetic input signals applied to the input ports in a predetermined manner to the output ports such that at least two distinguishable, independent composite beams of electromagnetic radiation having substantially the same far-field radiation pattern emanate from the radiating elements, wherein a first linear combination of individual beams emanating from the array of radiating elements together form a first one of the composite beams, and a second linear combination of individual beams emanating from the array of radiating elements together form a second one of the composite beams, the signals distributed to said output ports being defined by first and second sets thereof respectively associated with said two composite beams, wherein the signals in each of the sets thereof possess a preselected distribution of differing amplitudes and the distributions of amplitudes are essentially mirror images of each other.

2. An array antenna system as in claim 1 wherein the network distribution means is operatively arranged to receive one of the input signals at one of the input ports and another of the input signals at another of the input ports.

3. An array antenna system as in claim 1 wherein the network distribution means is operatively arranged so that the array excitations forming the first composite beam and the array excitations forming the second composite beam are mathematically orthogonal to one another.

4. An array antenna system as in claim 3 wherein:

the number of radiating elements equals N, and the mathematical orthogonality of the array excitations of the first and second composite beams satisfies the following equation:

$$\sum_{i=1}^{N} \overline{A_i} \cdot \overline{B_i^*} = 0$$

where $\overline{A_i}$ and $\overline{B_i}$ are linear combinations of excitation values associated with the individual beams produced by the array, and $\overline{B_i^*}$ is the complex conjugate of $\overline{B_i}$.

5. An array antenna system as in claim 4 wherein the distribution network means includes at least a first distribution network having four output ports, and at least four signal-dividing devices arranged in at least two interconnected stages, with each stage having at least two such devices, each of the signal-dividing devices having at least one input and a plurality of outputs, the input ports being directly connected to the inputs of the devices of the first of the two stages, the outputs of the devices of the first stage being connected to respective ones of the inputs of the devices of the second of the two stages, and the output ports being in communication with the output of the devices of the second stage.

6. An array antenna system as in claim 5, wherein:

the first distribution network includes at least two passive phase-shifting devices distinct from the signal-dividing devices, and a first pair of the output ports are directly connected to a first pair of outputs of the second stage, and a second pair of the output ports are connected through the two phase-shifting devices to a second pair of outputs of the second stage which are distinct and separate from the first pair of outputs of the second stage.

7. An array antenna system as in claim 6 wherein:

the distribution network means further includes at least four second distribution networks each having an input port connected to a respective one of the four output ports of the first distribution network, with each of said four distribution networks having at least a plurality of output ports connected to respective ones of the radiating elements, and the signal-dividing devices are directional couplers.

8. An array antenna system as in claim 4 wherein the distribution network means includes only passive reciprocal devices.

9. An array antenna system as in claim 2 wherein the distribution network means includes at least four directional couplers and at least two passive phase-shifting devices, the couplers being arranged in at least first and second interconnected stages, with the input ports being directly connected to the inputs of the couplers of the first stage, and the output ports being in communication with the outputs of the second stage of couplers, with the phase-shifting devices being disposed between at least selected ones of the output ports and selected ones of the outputs of the second stage.

10. An array antenna system as in claim 4 wherein:

the distribution network means and the radiating elements are arranged to operate in at least two modes A and B, with each mode being associated with a distinct one of the composite beams, and the array has an even number N of radiating elements and array factors $E_A$ and $E_B$ respectively associated with modes A and B, which satisfy the following equations:

$$E_A = (a_k + a_{k+1})\mathrm{COS}(\mu) + j(a_k - a_{k+1})\mathrm{SIN}(\mu) + (a_{k-1} + a_{k+2})\mathrm{COS}(3\mu) + j(a_{k-1} - a_{k+2})\mathrm{SIN}(3\mu) + \ldots + (a_1 + a_N)\mathrm{COS}[(N-1)\mu] + j(a_1 - a_N)\mathrm{SIN}[(N-1)\mu]$$

and $$E_B = (a_k + a_{k+1})\mathrm{COS}(\mu) - j(a_k - a_{k+1})\mathrm{SIN}(\mu) + (a_{k-1} + a_{k+2})\mathrm{COS}(3\mu) - j(a_{k-1} - a_{k+2})\mathrm{SIN}(3\mu) + \ldots + (a_1 + a_N)\mathrm{COS}[(N-1)\mu] - j(a_1 - a_N)\mathrm{SIN}[(N-1)\mu]$$

where $k=N/2$, and where $\mu=(\pi d \mathrm{SIN}\ \theta)/\lambda$ with $\lambda$=signal wavelength, $\theta$=beam scan angle, and d=spacing between radiating elements.

11. An array antenna system as in claim 4 wherein:

the distribution network means and the radiating elements are arranged to operate in at least two modes A and B, with each mode being associated with a distinct one of the composite beams, and the array has an odd number N of radiating elements and array factors $E_A$ and $E_B$ respectively associated with modes A and B, which satisfy the following equations:

$$E_A = a_L + (a_{L-1} + a_{L+1})\mathrm{COS}(2\mu) + j(a_{L-1} - a_{L+1})\mathrm{SIN}(2\mu) + (a_{L-2} + a_{L+2})\mathrm{COS}(4\mu) + j(a_{L-2} - a_{L+2})\mathrm{SIN}(4\mu) + \ldots + (a_1 + a_N)\mathrm{COS}[(N-1)\mu] + j(a_1 - a_N)\mathrm{SIN}[(N-1)\mu]$$

and $$E_B = a_L + (a_{L-1} + a_{L+1})\mathrm{COS}(2\mu) - j(a_{L-1} - a_{L+1})\mathrm{SIN}(2\mu) + (a_{L-2} + a_{L+2})\mathrm{COS}(4\mu) - j(a_{L-2} - a_{L+2})\mathrm{SIN}(4\mu) + \ldots + (a_1 + a_N)\mathrm{COS}[(N-1)\mu] - j(a_1 - a_N)\mathrm{SIN}[(N-1)\mu]$$

where $L=(N+1)/2$ and where $\mu=(\pi d \mathrm{SIN}\ \theta)/\lambda$ with $\lambda$=signal wavelength, $\theta$=beam scan angle, and d=spacing between radiating elements.

12. A direct receiving array antenna system for receiving a portion of each of at least two composite beams of electromagnetic radiation emanating from essentially coextensive far field radiating areas, being in the same general frequency range and having the same polarization, comprising:

a plurality of elements each arranged for receiving a portion of each of the beams; and network means, having a plurality of first ports connected to the elements and a plurality of second ports, for separating the two composite beams received by the elements into at least two distinct signals which are respectively output on distinct ones of the second ports, with each such distinct signal being derived from a distinct one of the beams, the plurality of array elements receiving a first linear combination of individual beams defining one of the two composite beams and receiving a second linear combination of individual beams defining the other of the two composite beams, the network means being responsive to the first and second linear combinations of individual beams to respectively produce first and second sets of signals at the first ports, wherein the signals in each of the sets thereof possess a preselected distribution of differing amplitudes and the distributions of amplitudes are essentially mirror images of each other.

13. An array antenna system as in claim 12, wherein:

the network means includes at least four signal-dividing devices arranged in at least two stages, with each stage having at least two such devices, each of the power dividing devices having at least two inputs and one output, the second ports being the outputs of the devices of the second of the two stages, each of the output of the devices of the first of the two stages being directly connected to the inputs of the devices of the second stage, and the first ports being in communication with the inputs of the devices of the first stage.

14. An array antenna system as in claim 13, wherein the four signal-dividing devices are directional couplers.

15. An array antenna system as in claim 14, wherein the network means includes at least two passive phase-shifting devices disposed between selected ones of the first ports and selected ones of the inputs of the devices of the first stage.

16. An array antenna system as in claim 12 wherein:

the network means and array of radiating elements are arranged to operate in two modes A and B, with each mode being associated with a distinct one of the composite beams, and the array has an even number of radiating elements and array factors $E_A$ and $E_B$ respectively associated with the modes A and B, which satisfy the following equations:

$$E_A = (a_k + a_{k+1})\mathrm{COS}(\mu) + j(a_k - a_{k+1})\mathrm{SIN}(\mu) + (a_{k-1} + a_{k+2})\mathrm{COS}(3\mu) + j(a_{k-1} - a_{k+2})\mathrm{SIN}(3\mu) + \ldots + (a_1 + a_N)\mathrm{COS}[(N-1)\mu] + j(a_1 - a_N)\mathrm{SIN}[(N-1)\mu]$$

and $$E_B = (a_k + a_{k+1})\mathrm{COS}(\mu) - j(a_k - a_{k+1})\mathrm{SIN}(\mu) +$$

-continued $$(a_{k-1} + a_{k+2})\mathrm{COS}(3\mu) - j(a_{k-1} - a_{k+2})\mathrm{SIN}(3\mu) + \ldots + (a_1 + a_N)\mathrm{COS}[(N-1)\mu] - j(a_1 - a_N)\mathrm{SIN}[(N-1)\mu]$$

where $k=N/2$, and where $\mu=(\pi d \mathrm{SIN}\ \theta)/\lambda$ with $\lambda$=signal wavelength, $\theta$=beam scan angle, and d=spacing between radiating elements.

17. An array antenna system as in claim 12 wherein:

the network means and array of radiating elements are arranged to cooperate in two modes A and B, with each mode being associated with a distinct one of the composite beams, and the array has an odd number of radiating elements and array factors $E_A$ and $E_B$ respectively associated with modes A and B, which satisfy the following equations:

$$E_A = a_L + (a_{L-1} + a_{L+1})\mathrm{COS}(2\mu) + j(a_{L-1} - a_{L+1})\mathrm{SIN}(2\mu) + (a_{L-2} + a_{L+2})\mathrm{COS}(4\mu) + j(a_{L-2} - a_{L+2})\mathrm{SIN}(4\mu) + \ldots + (a_1 + a_N)\mathrm{COS}[(N-1)\mu] + j(a_1 - a_N)\mathrm{SIN}[(N-1)\mu]$$

and $$E_B = a_L + (a_{L-1} + a_{L+1})\mathrm{COS}(2\mu) - j(a_{L-1} - a_{L+1})\mathrm{SIN}(2\mu) + (a_{L-2} + a_{L+2})\mathrm{COS}(4\mu) - j(a_{L-2} - a_{L+2})\mathrm{SIN}(4\mu) + \ldots + (a_1 + a_N)\mathrm{COS}[(N-1)\mu] - j(a_1 - a_N)\mathrm{SIN}[(N-1)\mu]$$

where $L=(N+1)/2$, and where $\mu=(\pi d \mathrm{SIN}\ \theta)/\lambda$ with $\lambda$=signal wavelength, $\theta$=beam scan angle, and d=spacing between radiating elements.

* * * * *